US005793007A

United States Patent [19]

Matsumoto

[11] Patent Number: 5,793,007

[45] Date of Patent: Aug. 11, 1998

[54] PARKING BRAKE APPARATUS HAVING A POSITION DETECTING UNIT FOR DETECTING A POSITION OF A ROTATING UNIT

[75] Inventor: Kazuhiko Matsumoto, Okazaki, Japan

[73] Assignee: Toyota Jidosha Kabushiki Kaisha, Aichi-ken, Japan

[21] Appl. No.: 795,620

[22] Filed: Feb. 6, 1997

[30] Foreign Application Priority Data

Feb. 26, 1996 [JP] Japan ..... 8-038343

[51] Int. Cl.[6] ..... H01H 9/06; G05G 5/06

[52] U.S. Cl. ..... 200/61.87; 74/523

[58] Field of Search ..... 200/61.62, 61.85, 200/61.87, 61.89, 61.73, 61.74, 61.75, 61.76, 61.77, 61.78, 61.79, 61.8, 61.81, 61.82; 74/523, 524, 528, 538

[56] References Cited

U.S. PATENT DOCUMENTS 4,181,834 1/1980 Kyonomine ..... 200/61.89
4,473,141 9/1984 Mochida ..... 74/538
4,896,007 1/1990 Yamazaki ..... 200/61.87
5,159,850 11/1992 Naoi et al. ..... 74/523

FOREIGN PATENT DOCUMENTS 3-085257 8/1991 Japan .

*Primary Examiner*—Khanh Dang
*Attorney, Agent, or Firm*—Kenyon & Kenyon

[57] ABSTRACT

A parking brake apparatus includes a rotating unit which is rotated around a rotating axis. A position detecting unit has a switch part which is movable in a direction of the detecting unit between a first position and a second position, the position detecting unit detecting a position of the rotating unit based upon a movement of the switch part. A pressing unit provided on the rotating unit moves the switch part in the direction, the pressing unit and the rotating unit being rotated together around the rotating axis when the rotating unit is rotated. The pressing unit moves the switch part by connection of the pressing unit with the switch part at a contact point when the rotating unit is rotated from a release position to a position exceeding the release position. The pressing unit and the switch part are arranged such that a distance between the contact point and the rotating axis is maintained below a reference distance.

10 Claims, 4 Drawing Sheets

PARKING BRAKE APPARATUS HAVING A POSITION DETECTING UNIT FOR DETECTING A POSITION OF A ROTATING UNIT

BACKGROUND OF THE INVENTION (1) Field of the Invention

The present invention generally relates to a parking brake apparatus for an automotive vehicle, and more particularly to an improvement of a parking brake apparatus having a position detecting unit which detects a position of a rotating unit of the parking brake apparatus. The present invention is suitably applied to a parking brake apparatus in which a parking brake pedal is rotated between a working position and a release position, a position of the parking brake pedal being detected by using a parking brake switch.

(2) Description of the Related Art

Japanese Laid-Open Utility Model Application No. 3-85257 discloses a lever type parking brake apparatus having a parking brake switch. The parking brake switch of the above publication detects a position of a parking brake lever which is manually rotated between a working position and a release position in the parking brake apparatus.

In the parking brake apparatus of the above publication, the parking brake lever is a rotating unit which is rotatably supported on an automotive vehicle. The parking brake lever is vertically rotatable around a rotating axis. When the parking brake lever is rotated down to the release position, the parking brake does not work and the vehicle can run. When the parking brake lever is rotated up to the working position, the parking brake works and the vehicle is parked. The parking brake switch is provided below the parking brake lever, and a switch part of the parking brake switch is pressed by the parking brake lever when it is rotated down to the release position.

In the above-mentioned parking brake apparatus, the switch part of the parking brake switch is movable in a direction which is the same as the direction of rotation of the parking brake lever. The switch part is moved down by the parking brake lever when it is set in the release position. The parking brake switch at this time outputs an ON signal indicating the release condition of the parking brake. On the other hand, the switch part is moved up by a biasing force of a spring when the parking brake lever is set in the working position. The parking brake switch at this time outputs an OFF signal indicating the working condition of the parking brake. Accordingly, it is possible to detect whether the parking brake lever is set in the release position or the working position if a determination as to whether the signal output from the parking brake switch is the ON signal or the OFF signal is made by using an electric circuit.

However, in the above-mentioned parking brake apparatus, the parking brake switch is arranged such that the direction of the movement of the switch part is the same as the direction of the rotation of the parking brake lever. According to this arrangement, if the parking brake lever is excessively rotated to a position exceeding the release position, the switch part of the parking brake switch is given a too great pressing force by the parking brake lever. In such cases, the parking brake switch may be damaged or malfunction.

Therefore, the above-mentioned parking brake apparatus is not appropriate for reliably protecting the parking brake switch against the damage or the malfunction which is likely to occur through extended use of the parking brake apparatus. It is unlikely that the above-mentioned parking brake apparatus extends the life of the parking brake switch.

SUMMARY OF THE INVENTION

A general object of the present invention is to provide an improved parking brake apparatus in which the above-described problems are eliminated.

Another, more specific object of the present invention is to provide a parking brake apparatus which effectively prevents the position detecting unit from being damaged by the rotating unit even when the rotating unit is excessively rotated to a position exceeding the release position.

The above-mentioned objects of the present invention are achieved by a parking brake apparatus which comprises: a rotating unit which is rotated around a rotating axis; a position detecting unit having a switch part which is movable in an axial direction of the position detecting unit between a first position and a second position, the position detecting unit detecting a position of the rotating unit based upon a movement of the switch part when the rotating unit is rotated between a working position and a release position; and a pressing unit provided on the rotating unit for moving the switch part in the axial direction, the pressing unit and the rotating unit being rotated together around the rotating axis when the rotating unit is rotated, wherein the pressing unit moves the switch part by connection of the pressing unit with the switch part at a contact point when the rotating unit is rotated from the release position to a position exceeding the release position, the pressing unit and the switch part being arranged such that a distance between the contact point and the rotating axis is maintained below a reference distance.

The above-mentioned objects of the present invention are achieved by a parking brake apparatus which comprises: a rotating unit which is rotated around a rotating axis; a position detecting unit having a switch part which is movable in an axial direction of the position detecting unit between a first position and a second position, the position detecting unit detecting a position of the rotating unit based upon a movement of the switch part when the rotating unit is rotated between a working position and a release position; and a pressing unit, provided on the rotating unit, which moves the switch part in the axial direction, the pressing unit and the rotating unit being rotated together around the rotating axis when the rotating unit is rotated, wherein the pressing unit moves the switch part by connection of the pressing unit with the switch part at a contact point when the rotating unit is rotated around the rotating axis by a rotating angle which is greater than a first angle and smaller than a second angle, and wherein the pressing unit and the switch part are arranged such that a distance between the contact point and the rotating axis when the rotating unit is rotated around the rotating axis by the rotating angle is greater than a first distance between the rotating axis and the first position and smaller than a second distance between the rotating axis and the second position.

The parking brake apparatus of the present invention comprises the pressing unit which includes a circular peripheral surface having a constant radius around the rotating axis, the pressing unit moving the switch part by connection of the peripheral surface with the switch part at the contact point on the peripheral surface. Thus, the parking brake apparatus of the present invention can effectively prevent the position detecting unit from being damaged by the rotating unit which is excessively rotated to the position exceeding the release position.

The parking brake apparatus of the present invention comprises a spring unit which is provided between the pressing unit and the switch part. When the rotating unit is rotated, the switch part is not directly touched by the pressing unit, and there is no frictional abrasion of the switch part which may be produced by the contact of the rotating unit with the switch part. Thus, the parking brake apparatus of the present invention can effectively prevent the wearing of the switch part of the position detecting unit, and it is possible to improve the life of the position detecting unit.

Further, the spring unit of the present invention allows the pressing force from the rotating unit to act on the switch part of the position detecting unit in a direction at right angles to the axial direction of the position detecting unit. The spring unit can reduce the pressing force acting on the switch part in the axial direction of the position detecting unit. Thus, the parking brake apparatus of the present invention can effectively reduce the wearing of the position detecting unit if the pressing force is increased.

BRIEF DESCRIPTION OF THE DRAWINGS

The above and other objects, features and advantages of the present invention will become more apparent from the following detailed description when read in conjunction with the accompanying drawings in which.

DETAILED DESCRIPTION OF THE PREFERRED EMBODIMENT

A description will now be given of the preferred embodiment of the present invention with reference to the accompanying drawings.

Figure 1:
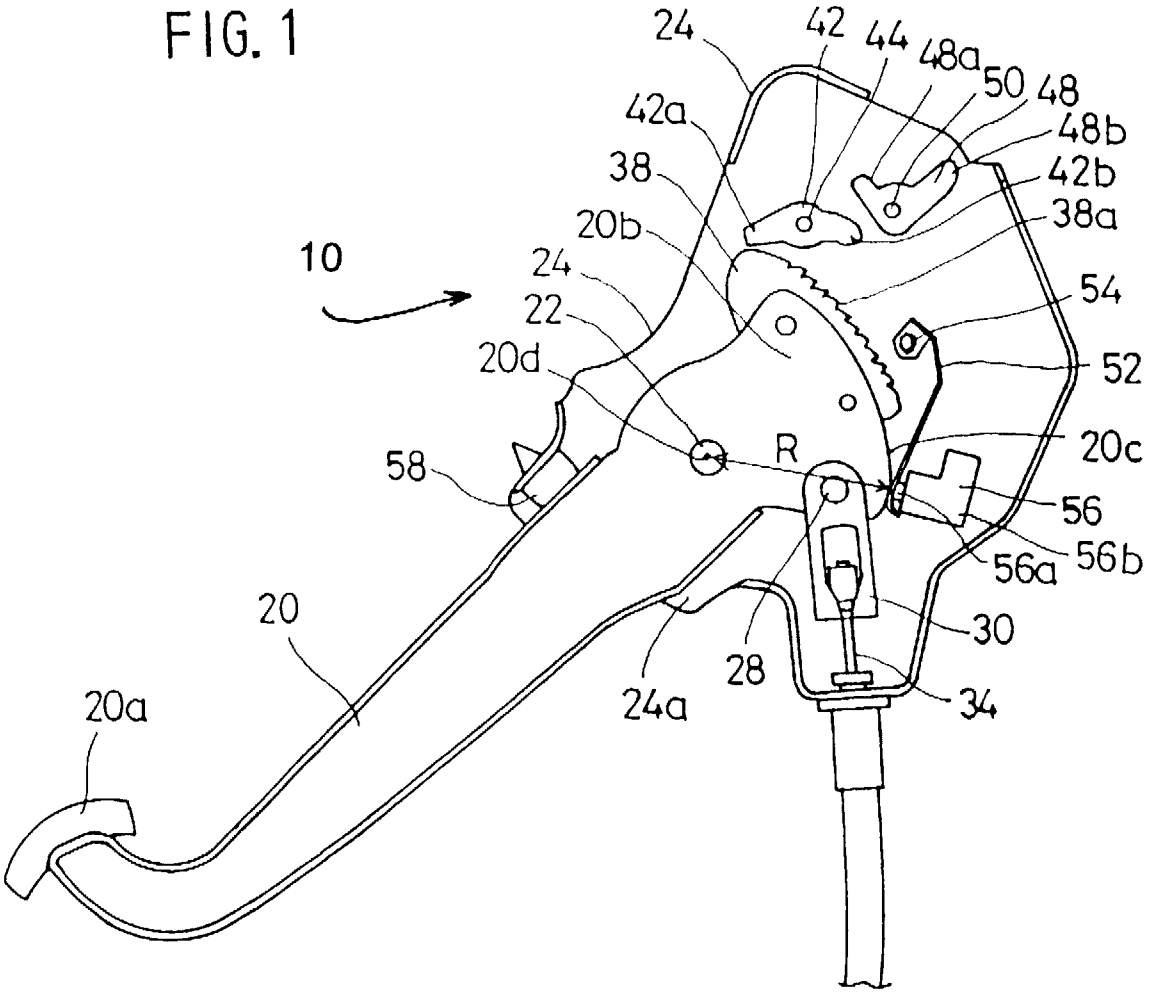
FIG. 1 is a diagram showing a parking brake apparatus to which one embodiment of the present invention is applied, in which a parking brake pedal is set at a release position.

FIG. 1 shows a pedal type parking brake apparatus 10 to which one embodiment of the present invention is applied. In this parking brake apparatus 10, a parking brake pedal 20 is set at a release position.

Referring to FIG. 1, the parking brake pedal 20 is rotatably supported on a base bracket 24 by a pin 22. The base bracket 24 is fixed to an automotive vehicle (not shown). As shown in FIG. 1, the parking brake pedal 20 extends slantingly downward from a pedal opening 24*a* of the base bracket 24. A pedal portion 20*a* is provided at one end (the bottom left corner of FIG. 1) of the parking brake pedal 20, and a pedal working portion 20*b* is provided at the other end (the right side of FIG. 1) of the parking brake pedal 20.

The pedal working portion 20*b* includes a pedal sliding surface 20*c* which is provided on an end surface of the pedal working portion 20*b*. The parking brake pedal 20 has a rotating axis 20*d* around which the parking brake pedal 20 is rotated. The pedal sliding surface 20*c* is formed on the periphery of the pedal working portion 20*b* such that the cross section of the pedal sliding surface 20*c* is a minor arc of a circle, and the pedal sliding surface 20*c* has a constant radius "R" around the rotating axis 20*d* as indicated by the arrow "R" in FIG. 1.

In the parking brake apparatus 10 of the present embodiment, the pedal working portion 20*b* moves a switch part by connection of the pedal sliding surface 20*c* with the switch part at a contact point on the pedal sliding surface 20*c* when the parking brake pedal 20 is excessively rotated from the release position to a position exceeding the release position, which will be described later. A distance between the contact point on the pedal sliding surface 20*c* and the rotating axis 20*d* is maintained below a reference distance which is nearly the same as the radius R. Only end portions of the pedal sliding surface 20*c* are rounded to a small radius (which is smaller than the radius "R") and smoothly merge with the external profile of the parking brake pedal 20.

A clevis 30 is rotatably supported on the parking brake pedal 20 by a clevis pin 28, and the clevis 30 is rotatable around the clevis pin 28 on the parking brake pedal 20. The clevis pin 28 is provided below the pedal working portion 20*b* of the parking brake pedal 20 as shown in FIG. 1. The clevis 30 is connected to one end of a brake cable 34, and the other end of the brake cable 34 is connected to a parking brake system (not shown). A tensile force from the brake cable 34 is transmitted to the parking brake pedal 20 via the clevis 30, and the tensile force is exerted so as to rotate the parking brake pedal 20 clockwise around the pin 22.

A sector gear 38 is provided above the pedal working portion 20*b* and fixed to the parking brake pedal 20. The sector gear 38 has a plurality of gear teeth 38*a* on a side surface of the sector gear 38. As shown in FIG. 1, the teeth 38*a* are arranged such that the teeth 38*a* extend toward the right side of the pedal working portion 20*b* along the outside periphery of the pedal sliding surface 20*c* and partially project toward the left side of the pedal working portion 20*b*.

A pole 42 is provided above the teeth 38*a* of the sector gear 38. The pole 42 is rotatably supported on the base bracket 24 by a pole pin 44 such that the pole 42 is rotatable around the pole pin 44 on the base bracket 24. The pole 42 has claw portions 42*a* and 42*b* which are provided at both ends of the pole 42. As shown in FIG. 1, the claw portion 42*a* extends toward the left of the pole 42, and the claw portion 42*b* extends toward the right of the pole 42. A rotating force of a spring (not shown) is exerted on the pole 42 such that the pole 42 is rotated counterclockwise around the pole pin 44 by the rotating force of the spring. As the spring always exerts the rotating force on the pole 42 to rotate the pole 42 counterclockwise around the pole pin 44, the claw portion 42*a* of the pole 42 presses an upper portion of the sector gear 38 which is located above the teeth 38*a*, and the sector gear 38 is pressed downward by the pole 42.

As shown in FIG. 1, a release lever 48 is provided on the right side of the pole 42. The release lever 48 is an "inverted-L" shaped member. Similarly to the pole 42, the release lever 48 is rotatably supported on the base bracket 24 by a release lever pin 50 such that the release lever 48 is rotatable around the release lever pin 50 on the base bracket 24. The release lever 48 has arm portions 48*a* and 48*b* which are provided at both ends of the release lever 48.

When the parking brake pedal 20 is set at the release position, as shown in FIG. 1, the release lever 48 is arranged such that the arm portion 48*a* extends slantingly upward on the left side of the release lever 48, and the arm portion 48*b* extends slantingly upward on the right side of the release lever 48.

A leaf spring 52 is provided on the right side of the pedal working portion 20*b* of the pedal 20. The leaf spring 52 is a spring unit made of one or a plurality of flexible metallic strips, and the leaf spring 52 has a given width in a direction perpendicular to the plane of FIG. 1. The leaf spring 52 is fixed at its upper end to the base bracket 24 by a bolt 54. The lower end of the leaf spring 52 is placed between the pedal working portion 20*b* and a parking brake switch 56 (which will be described later). A resilient deformation of the leaf spring 52 around the bolt 54 is allowed when an external force is exerted against the lower end of the leaf spring 52.

When the parking brake pedal 20 is set in the release position, as shown in FIG. 1, the pedal sliding surface 20*c* of the pedal 20 is brought into contact with the lower end of the leaf spring 52. The leaf spring 52 in this condition is resiliently deformed (or rotated counterclockwise around the bolt 54), and the leaf spring 52 is moved to the right side of FIG. 1 by the pedal sliding surface 20*c* of the pedal 20.

It should be noted that the distance between the rotating axis 20*d* and the contact point of the leaf spring 52 to the parking brake pedal 20 is maintained to be the same as the radius R of the pedal sliding surface 20*c* when the pedal 20 is rotated.

A parking brake switch 56 is provided on the right side of the pedal working portion 20*b* of the parking brake pedal 20 at a location adjacent the leaf spring 52. The parking brake switch 56 is a position detecting unit which detects a position of the parking brake pedal 20 which is rotated around the rotating axis 20*d*. The parking brake switch 56 includes a switch knob 56*a* and a case 56*b*. When the parking brake pedal 20 is set in the release position, as shown in FIG. 1, the parking brake switch 56 is arranged such that the switch knob 56*a* is moved down to a lower position (to the right side of FIG. 1) by the leaf spring 52.

In the above-described embodiment, when the switch knob 56*a* is pressed by the leaf spring 52, the parking brake switch 56 outputs an OFF signal indicating an OFF state of the parking brake pedal 20. Therefore, when the parking brake pedal 20 is set at the release position, the parking brake switch 56 outputs the OFF signal. On the other hand, when the switch knob 56*a* is not pressed by the leaf spring 52, the parking brake switch 56 outputs an ON signal indicating an ON state of the parking brake pedal 20, that is, the parking brake pedal 20 being set at the working position, not the release position.

Figure 2:
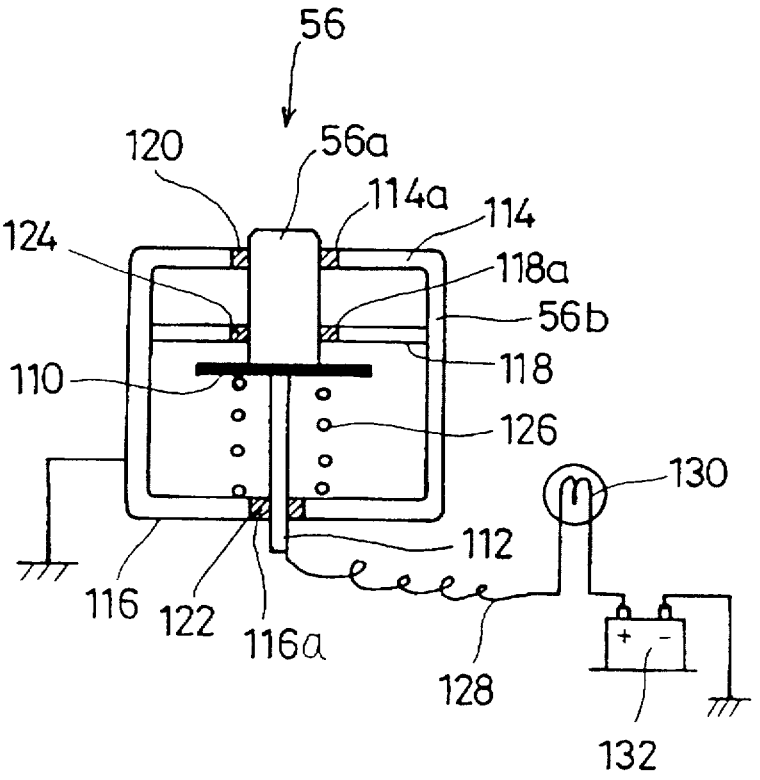
FIG. 2 is a diagram showing a parking brake switch of the parking brake apparatus in FIG. 1.

FIG. 2 shows the parking brake switch 56 of the parking brake apparatus 10 in FIG. 1. For the sake of convenience, in the parking brake switch 56 in FIG. 2, the switch knob 56*a* is pressed by the leaf spring 52.

Referring to FIG. 2, the switch knob 56*a* is a cylindrical switch part made of an insulating material. A switch plate 110 and a conductive shaft 112 are provided below the switch knob 56*a*. The switch plate 110 and the conductive shaft 112 are made of a conductive material. When the switch knob 56*a* is pressed by the leaf spring 52, the switch plate 110 is contacted by the bottom surface of the switch knob 56*a*. The shaft 112 is arranged such that it extends downward from the bottom of the switch plate 110 along the central axis of the switch knob 56*a*.

The case 56*b* is a box-like protective unit made of a conductive material. As shown in FIG. 2, the case 56*b* is grounded at an appropriate location. The case 56*a* has a top end surface 114 and a bottom end surface 116. A contact plate 118 which is parallel to both the top end surface 114 and the bottom end surface 116 is provided at an intermediate location within the case 56*b*. The contact plate 118 is made of a conductive material.

The top end surface 114 has a central opening 114*a* and the contact plate 118 has a central opening 118*a*, and the central openings 114*a* and 118*a* are provided coaxially with each other. The switch knob 56*a* is inserted into the central openings 114*a* and 118*a*. An insulating member 120 and an insulating member 124 are respectively provided on the inside periphery of the central opening 114*a* and the inside periphery of the central opening 118*a* such that the switch knob 56*a* is slidably supported on the insulating members 120 and 124.

Similarly, the bottom end surface 116 has a coaxially-provided central opening 116*a*, and the shaft 112 is inserted into the central opening 116*a*. An insulating member 122 is provided on the inside periphery of the central opening 116*a* such that the shaft 112 is slidably supported on the insulating member 122.

A spring 126 between the switch plate 110 and the bottom end surface 116 is provided coaxially with the shaft 112 within the case 56*b*. The spring 126 exerts an upward pressing force on the switch knob 56*a* via the switch plate 110 such that the top of the switch knob 56*a* is made to project upward from the central opening 114*a* of the top end surface 114 by the pressing force of the spring 126. The bottom end of the conductive shaft 112 is electrically connected to an indicator lamp 130 by a lead wire 128, and the indicator lamp 130 is electrically connected to a power supply 132.

When the switch knob 56*a* of the parking brake switch 56 is pressed by the leaf spring 52, as shown in FIG. 2, the switch plate 110 is separated from the contact plate 118, so that the conductive shaft 112 is insulated from the case 56*b*. The indicator lamp 130 at this time is turned OFF. In other words, when the switch knob 56*a* is pressed by the leaf spring 52, the parking brake switch 56 outputs the OFF signal indicating the OFF state of the parking brake pedal 20 (which is set at the release position as shown in FIG. 1).

Figure 3:
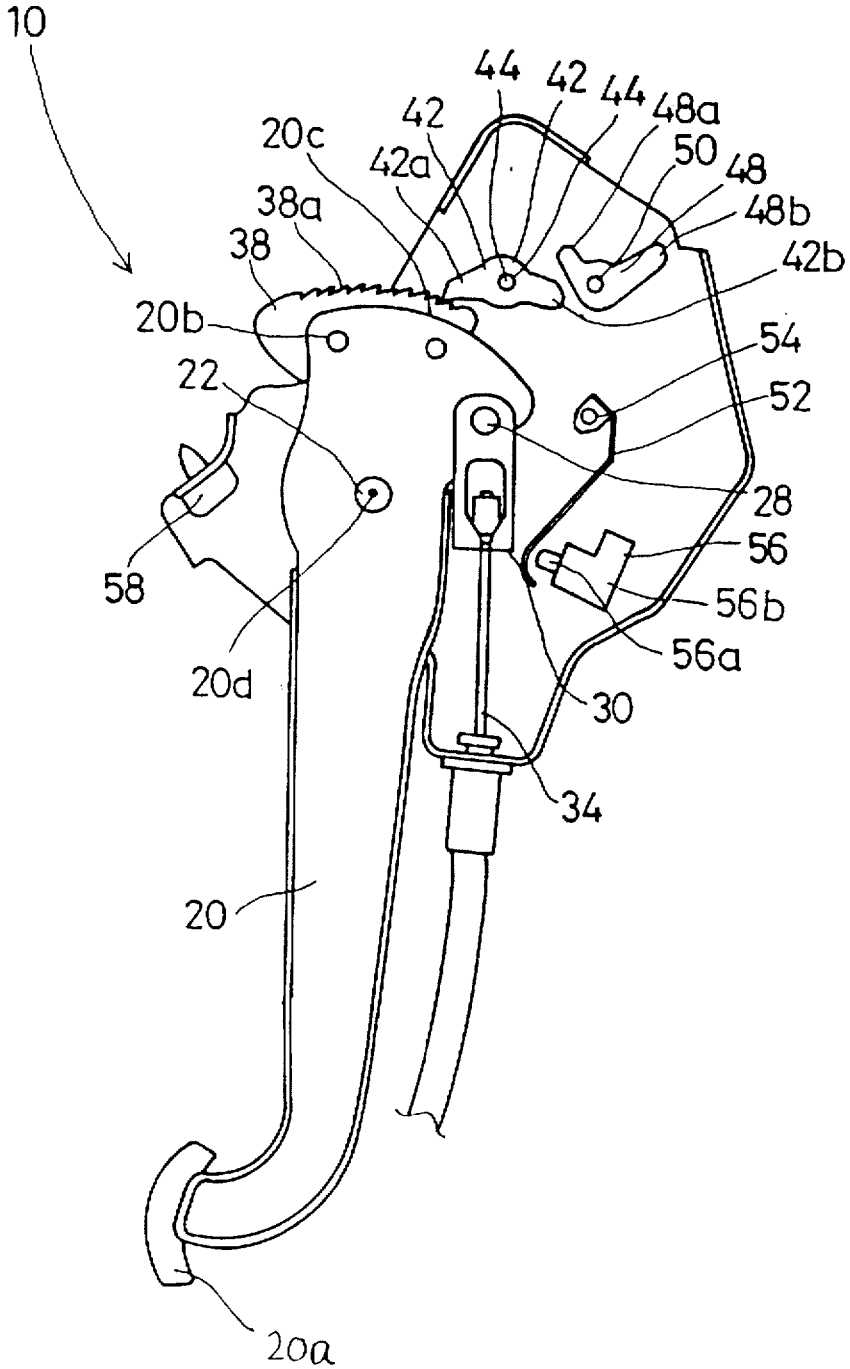
FIG. 3 is a diagram showing the parking brake apparatus in which the parking brake pedal is set at a working position.

When the switch knob 56*a* is not pressed by the leaf spring 52, the switch knob 56*a* is moved up to an upper position (which is above the central opening 114*a* of the top end surface 114) by the upward pressing force of the spring 126, so that the switch plate 110 touches the contact plate 118. Electrical conduction between the conductive shaft 112 and the case 56*b* is allowed by the contact between the contact plate 118 and the switch plate 110. The indicator lamp 130 at this time is turned ON. In other words, when the switch knob 56*a* is not pressed, the parking brake switch 56 outputs the ON signal indicating the ON state of the parking brake pedal 20 (it is set at the working position as shown in FIG. 3).

It should be noted that, as shown in FIG. 1, the axial direction of the switch 56 in which the switch knob 56*a* is moved by the pedal working portion 20*b* always faces the rotating axis 20*d* of the pedal 20. This arrangement effectively reduces a frictional abrasion of the switch knob 56*a* produced by the contact of the leaf spring 52 with the switch part 56*a*.

In the above-described embodiment, the indicator lamp 130 is provided. Alternatively, a potential measuring device which measures a potential difference between the conductive shaft 112 and the case 56*b* may be used. In such a case, it is possible to determine whether the parking brake switch 56 outputs the ON signal or the OFF signal, depending on the potential difference measured by the potential measuring device.

Further, as shown in FIG. 1, a pedal stopper rubber 58 is provided on the inside peripheral portion of the pedal opening 24*a* of the base bracket 24. As described above, the brake cable 34 exerts the tensile force on the parking brake pedal 20 via the clevis 30, such that the parking brake pedal 20 is rotated clockwise around the pin 22 by the tensile force of the brake cable 34. As the parking brake pedal 20 presses the pedal stopper rubber 58 against the pedal opening 24a of the base bracket 24 due to the tensile force of the brake cable 34, the pedal stopper rubber 58 prevents the parking brake pedal 20 from being excessively rotated to the over-stroke position exceeding the release position.

When a vehicle operator depresses the pedal 20a of the parking brake pedal 20 so as to move the parking brake pedal 20 from the release position (shown in FIG. 1) to the working position against the tensile force of the brake cable 34, the parking brake pedal 20 is rotated counterclockwise around the pin 22 by the depressing force of the vehicle operator.

FIG. 3 shows the parking brake apparatus 10 in which the parking brake pedal 20 is set at the working position. As shown in FIG. 3, the brake cable 34 is pulled upward by the depressing force of the vehicle operator on the parking brake pedal 20. The parking brake system (not shown) is actuated by the upward movement of the brake cable 34 so that a braking force of the parking brake system is exerted on the vehicle.

As described above, the rotating force of the spring (not shown) is always exerted on the pole 42 to rotate the pole 42 counterclockwise around the pole pin 44, and the sector gear 38 is pressed downward by the claw portion 42a of the pole 42. When the parking brake pedal 20 is set at the working position, as shown in FIG. 3, the claw portion 42a is engaged with the teeth 38a of the sector gear 38. The clockwise rotation of the parking brake pedal 20 around the pin 22 is inhibited by the engagement of the claw portion 42a and the teeth 38a of the sector gear 38. Thus, even if the vehicle operator releases the pedal 20a, the parking brake pedal 20 is maintained at the working position as shown in FIG. 3.

When the parking brake pedal 20 is set at the working position, as shown in FIG. 3, the pedal working portion 20b is moved up and the pedal sliding surface 20c is separated from the leaf spring 52. The leaf spring 52 in this condition is returned to the original location and not resiliently deformed (or rotated clockwise around the bolt 54). The leaf spring 52 is moved to the left side of FIG. 3 due to the resilient force of the leaf spring 52 by the separation of the pedal sliding surface 20c. The leaf spring 52 is separated from the switch knob 56a of the parking brake switch 56. Thus, the switch knob 56a is moved up to the upper position by the pressing force of the spring 126 (FIG. 2).

As the switch knob 56a is moved up to the upper position, the switch plate 110 of the parking brake switch 56 is brought into contact with the contact plate 118. Therefore, when the pedal 20 is set at the working position as shown in FIG. 3, the parking brake switch 56 outputs the ON signal indicating the On state of the parking brake pedal 20. By detecting the ON signal output from the parking brake switch 56, it is possible to detect that the pedal 20 is set at the working position.

When the pedal 20 is returned from the working position (FIG. 3) to the release position (FIG. 1), the vehicle operator sets an operation lever (not shown) at an ON position. The operation lever is connected to the release lever 48 of the parking brake apparatus 10, and, when the operation lever is set at the ON position, the release lever 48 is rotated counter-clockwise around the release lever pin 50 by connection of the operation lever with the release lever 48.

As the release lever 48 is rotated counter-clockwise, the arm portion 48a is connected to the claw portion 42b of the pole 42. By the connection of the arm portion 48a with the claw portion 42b, the pole 42 is rotated clockwise around the pole pin 44. By the clockwise rotation of the pole 42, the claw portion 42a is disengaged from the teeth 38a of the sector gear 38 on the parking brake pedal 20. By the separation of the pole 42 from the sector gear 38, the parking brake pedal 20 is rotated clockwise around the pin 22 due to the tensile force of the brake cable 34. Consequently, when the vehicle operator sets the operation lever at the ON position, the parking brake pedal 20 is returned from the working position back to the release position.

As described above, the tensile force of the brake cable 34 is exerted on the parking brake pedal 20 so as to rotate the parking brake pedal 20 clockwise around the pin 22. In other words, the parking brake pedal 20 is urged to move toward an over-stroke position exceeding the release position (FIG. 1) by the tensile force of the brake cable 34. If the tensile force of the brake cable 34 is excessively great, the parking brake pedal 20 may be abruptly returned to the over-stroke position exceeding the release position after the vehicle operator sets the operation lever at the ON position.

Figure 4:
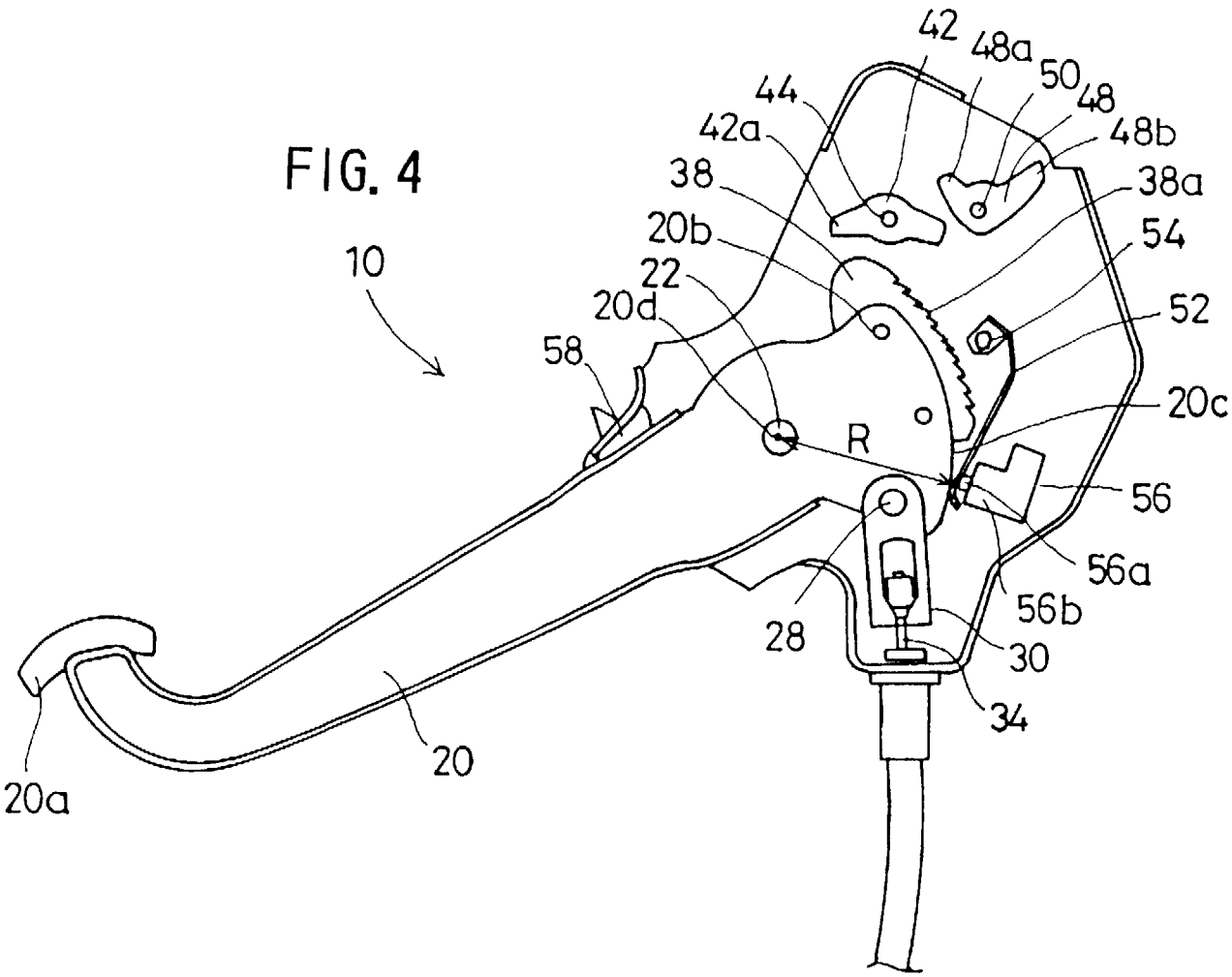
FIG. 4 is a diagram showing the parking brake apparatus in which the parking brake pedal is excessively rotated to a position exceeding the release position.

FIG. 4 shows the parking brake apparatus 10 in which the parking brake pedal 20 is returned from the working position (FIG. 3) to the over-stroke position exceeding the release position (FIG. 1). In FIG. 4, as the parking brake pedal 20 is excessively rotated to the over-stroke position, the pedal stopper rubber 58 is compressed against the pedal opening 24a of the base bracket 24 by the parking brake pedal 20.

The pedal sliding surface 20c of the parking brake pedal 20 in the present embodiment has the radius "R" around the rotating axis 20d, and the distance between the rotating axis 20d and the contact point of the leaf spring 52 to the parking brake pedal 20 is kept to be the same as the radius R of the pedal sliding surface 20c when the parking brake pedal 20 is rotated. Therefore, when the parking brake pedal 20 is rotated around the rotating axis 20d under the condition in which the pedal sliding surface 20c touches the leaf spring 52, the distance between the rotating axis 20d and the contact point of the leaf spring 52 to the parking brake pedal 20 remains unchanged and does not exceed the radius R.

As shown in FIG. 1 through FIG. 4, in the above-described embodiment, the pedal working portion 20b moves the switch knob 56a in the axial direction of the switch 56 by connection of the pedal sliding surface 56c with the switch knob 56a at a contact point on the pedal sliding surface 20c when the parking brake pedal 20 is excessively rotated from the release position in FIG. 1 to the over-stroke position in FIG. 4. As described above, the pedal working portion 20b and the switch knob 56a are arranged such that a distance between the contact point on the pedal sliding surface 20c and the rotating axis 20d is maintained below the reference distance.

Further, as shown in FIG. 1 through FIG. 4, in the above-described embodiment, the pedal working portion 20b moves the switch knob 56a in the axial direction of the switch 56 by connection of the pedal sliding surface 20c with the switch knob 56a at a contact point on the pedal sliding surface 56c when the parking brake pedal 20 is rotated around the rotating axis 20d by a rotating angle which is greater than a first angle (which corresponds to a rotating angle of the pedal 20 from the working position in FIG. 3 to the release position in FIG. 1) and smaller than a second angle (which corresponds to a rotating angle of the pedal 20 from the working position in FIG. 3 to the over-stroke position in FIG. 4). The pedal working portion 20b and the switch knob 56a are arranged such that the distance between the contact point on the pedal sliding surface 20*c* and the rotating axis 20*d* when the pedal 20 is rotated by the above rotating angle is greater than a first distance between the rotating axis 20*d* and the upper position (not shown in FIG. 2) of the switch knob 56*a* and smaller than a second distance between the rotating axis 20*d* and the lower position (FIG. 2) of the switch knob 56*a*.

Accordingly, when the parking brake pedal 20 is returned from the working position to the over-stroke position exceeding the release position, as shown in FIG. 4, the deformation of the leaf spring 52 is always maintained at the same as the deformation of the leaf spring 52 with the parking brake pedal 20 set at the release position in FIG. 1. In the present embodiment, the switch knob 56*a* of the parking brake switch 56 is effectively prevented from being excessively pressed by the parking brake pedal 20 which is returned to the over-stroke position. The movement of the switch knob 56*a* in the axial direction of the parking pedal switch 56 by the parking brake pedal 20 is maintained below a reference level when the parking brake pedal 20 is excessively rotated to the over-stroke position.

Therefore, the parking brake apparatus 10 of the present embodiment can effectively prevent the parking brake switch 56 from being damaged by the parking brake pedal 20 which is excessively rotated to the position exceeding the release position.

In addition, in the above-described embodiment, the parking brake apparatus 10 includes the leaf spring 52 between the pedal sliding surface 20*c* and the parking brake switch 56. When the parking brake pedal 20 is rotated, the switch knob 56*a* of the parking brake switch 56 is not directly touched by the pedal sliding surface 20*c*, and there is no frictional abrasion of the switch knob 56*a* which is produced by the contact of the parking brake pedal 20 with the switch knob 56*a*. Thus, the parking brake apparatus 10 of the present embodiment can effectively prevent the wearing of the switch knob 56*a* of the parking brake switch 56, and it is possible for the parking brake apparatus 10 of the present embodiment to improve the life of the parking brake switch 56.

Further, in the above-described embodiment, a pressing force from the pedal sliding surface 20*c* acting on the switch knob 56*a* in a direction at right angles to the axial direction of the parking brake switch 56 can be reduced since the leaf spring 52 is interposed between the pedal sliding surface 20*c* and the switch knob 56*a* when the switch knob 56*a* is moved up and down. Thus, the parking brake apparatus 10 of the present embodiment can effectively reduce the wearing of the switch knob 56*a* and the case 56*b* if the above-mentioned force is increased. It is possible for the parking brake apparatus 10 of the present embodiment to improve the life of the parking brake switch 56.

Further, in the above-described embodiment, the end portions of the pedal sliding surface 20*c* are rounded to a small radius and smoothly merge with the external profile of the parking brake pedal 20. It is possible that the switch knob 56*a* of the parking brake switch 56 is smoothly moved between the upper position and the lower position. Thus, the parking brake apparatus 10 of the present embodiment can improve the life of the parking brake switch 56.

Further, in the above-described embodiment, the parking brake apparatus 10 ensures that the switch knob 56*a* is not excessively moved down to a position exceeding the lower position in the parking brake switch 56, irrespective of whether the rotational angle of the parking brake pedal 20 around the rotating axis 20*d* is great or small. When the parking brake pedal 20 and the parking brake switch 56 are located in the parking brake apparatus 10, it is sufficient to pay attention to that, when the parking brake pedal 20 is set at the release position, the switch knob 56*a* is not moved by the leaf spring 52 down to the position exceeding the lower position. It is not necessary to pay attention to that the downward movement of the switch knob 56*a* is not excessive when the parking brake pedal 20 is rotated to a maximum rotational angle. As the accuracy required to locate the component parts in the parking brake apparatus 10 is moderated, the parking brake apparatus 10 of the present embodiment can effectively reduce the cost of the vehicle assembly. This advantage can be obtained even if the present invention is applied to a lever type parking brake apparatus in which a parking brake lever is rotated between the working position and the release position.

In the above-described embodiment, when the parking brake pedal 20 is set at the release position the switch knob 56*a* of the parking brake switch 56 is moved down to the lower position, and when the parking brake pedal 20 is set at the working position the switch knob 56*a* is moved up to the upper position. However, the present invention is not limited to this embodiment. A modification may be made such that when the parking brake pedal 20 is set at the release position the switch knob 56*a* of the parking brake switch 56 is moved up to the upper position, and when the parking brake pedal 20 is set at the working position the switch knob 56*a* is moved down to the lower position. The advantages which are the same as those of the above-described embodiment can be obtained by this modification.

What is claimed is:

1. A parking brake apparatus comprising:

a rotating unit which is rotated around a rotating axis from a working position in which the parking brake is applied to a release position in which the parking brake is released;

a position detecting unit defining a position detecting unit axis, the position detecting unit having a switch part movable along the position detecting unit axis between a first position and a second position, the position detecting unit detecting a position of the rotating unit based on a movement of the switch part when the rotating unit is rotated between the working position and the release position; and a pressing unit provided on the rotating unit so that, when the rotating unit is rotated about the rotating axis, the pressing unit is rotated together with the rotating unit, wherein contact between the switch part and the pressing unit moves the switch part between the first and second positions, wherein the pressing unit and the switch part are arranged such that, when the rotating unit is rotated away from the working position past the release position, a distance between the rotating axis and a point of contact between the pressing unit and the switch part is maintained below a predetermined distance.

2. The apparatus according to claim 1, further comprising a leaf spring provided between the switch part and the pressing unit.

3. The apparatus according to claim 1, wherein the pressing unit comprises a substantially circular peripheral surface having a substantially constant radius around the rotating axis.

4. A parking brake apparatus comprising:

a rotating unit which is rotated around a rotating axis from a working position in which the parking brake is applied to a release position in which the parking brake is released;

a position detecting unit defining a position detecting unit axis, the position detecting unit having a switch part movable along the position detecting unit axis between a first position and a second position, the position detecting unit detecting a position of the rotating unit based on a movement of the switch part when the rotating unit is rotated between the working position and the release position; and a pressing unit provided on the rotating unit so that, when the rotating unit is rotated about the rotating axis, the pressing unit is rotated together with the rotating unit, wherein contact between the switch part and the pressing unit moves the switch part between the first and second positions when the rotating unit is rotated away from the working position around the rotating axis by a rotating angle which is greater than an angle corresponding to the release position, and wherein the pressing unit and the switch part are arranged such that, when the rotating unit is rotated through the rotating angle, a contact distance between the rotating axis and a point of contact between the pressing unit and the switch part is greater than a first distance so that the switch part is moved into the first position, wherein the contact distance is smaller than a second distance between the rotating axis and the point of contact when the switch part is in the second position.

5. The apparatus according to claim 4, further comprising a leaf spring provided between the switch part and the pressing unit.

6. The apparatus according to claim 4, wherein the pressing unit comprises a substantially circular peripheral surface having a substantially constant radius around the rotating axis.

7. The apparatus according to claim 1, wherein the pressing unit axis extends along a line passing through the rotating axis.

8. The apparatus according to claim 1, wherein the pressing unit moves the switch part into the second position when the rotating unit is moved into the release position, and wherein, when the rotating unit is moved into the working position, the pressing unit is separated from the switch part and the switch part moves into the first position.

9. The apparatus according to claim 1, further comprising:

a leaf spring provided between the switch part and the pressing unit for pressing the switch part into the first position when the rotating unit is set in the working position, and wherein, in the release position, the leaf spring is separated from the switch part, so that the switch part moves into the first position.

10. The apparatus according to claim 1, further comprising:

a fixed bracket in which the rotating unit is mounted;

a stopper rubber provided on an inside peripheral portion of an opening formed in the fixed bracket, wherein the stopper rubber prevents the rotating unit from being rotated away from the working position past the release position.

* * * * *